US007201634B1

(12) United States Patent
Naujok et al.

(10) Patent No.: US 7,201,634 B1
(45) Date of Patent: Apr. 10, 2007

(54) POLISHING METHODS AND APPARATUS

(75) Inventors: Markus Naujok, Hopewell Junction, NY (US); Erdem Kaltalioglu, Newburgh, NY (US)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 11/273,134

(22) Filed: Nov. 14, 2005

(51) Int. Cl.
*B24B 7/22* (2006.01)

(52) U.S. Cl. ..... 451/7; 451/288; 451/53

(58) Field of Classification Search ..... 451/7, 451/6, 53, 288, 287, 41
See application file for complete search history.

(56) References Cited

U.S. PATENT DOCUMENTS

| | | | | |
|---|---|---|---|---|
| 4,450,652 | A | 5/1984 | Walsh | |
| 5,127,196 | A * | 7/1992 | Morimoto et al. | 451/7 |
| 5,775,980 | A * | 7/1998 | Sasaki et al. | 451/285 |
| 5,957,750 | A * | 9/1999 | Brunelli | 451/7 |
| 5,972,792 | A * | 10/1999 | Hudson | 438/691 |
| 6,020,262 | A | 2/2000 | Wise et al. | |
| 6,095,898 | A | 8/2000 | Hennhöfer et al. | |
| 6,150,271 | A | 11/2000 | Easter et al. | |
| 6,299,514 | B1 | 10/2001 | Boller | |
| 6,315,635 | B1 * | 11/2001 | Lin | 451/7 |
| 6,561,381 | B1 | 5/2003 | Osterheld et al. | |
| 6,834,777 | B2 | 12/2004 | Osterheld et al. | |
| 6,953,750 | B1 * | 10/2005 | Wu et al. | 438/691 |
| 6,976,902 | B2 * | 12/2005 | Koo et al. | 451/7 |
| 2001/0055940 | A1 * | 12/2001 | Swanson | 451/53 |
| 2002/0039874 | A1 * | 4/2002 | Hecker et al. | 451/7 |

OTHER PUBLICATIONS

Nishimoto, A., et al., "An In-situ Sensor for Reduced Consumable Usage Through Control of CMP," NSF/SRC Engineering Research Center for Environmentally Benign Semiconductor Manufacturing, 16 pp. MIT Microsystems Technology Laboratories, Cambridge, MA.

Nishimoto, A., et al., "An In-situ Sensor for Reduced Consumable Usage Through Control of CMP," Extended Abstracts, SRC TechCon '98, Sep. 1998, 4 pages, Semiconductor Research Corporation, Las Vegas, NV.

Sorooshian, J., et al., "Arrhenius Characterization of ILD and Copper CMP Processes," Journal of the Electrochemical Society, 2004, vol. 151, Issue 2, pp. G85-G88, The Electrochemical Society, Inc., Pennington, NJ.

* cited by examiner

*Primary Examiner*—Robert A. Rose
(74) *Attorney, Agent, or Firm*—Slater & Matsil, L.L.P.

(57) ABSTRACT

Apparatus for and methods of chemical mechanical polishing (CMP) of semiconductor wafers are disclosed. A preferred embodiment comprises an apparatus for polishing a semiconductor workpiece that includes a polishing pad, a fluid dispenser adapted to dispense a fluid to the polishing pad, and a temperature measurement device adapted to measure the temperature of the fluid. The apparatus includes a heat exchanger adapted to increase or decrease the temperature of the fluid.

24 Claims, 2 Drawing Sheets

POLISHING METHODS AND APPARATUS

TECHNICAL FIELD

The present invention relates generally to apparatus and manufacturing processes for semiconductor devices, and more particularly to polishing processes and apparatus.

BACKGROUND

Semiconductor devices are manufactured by depositing many different types of material layers over a semiconductor workpiece or wafer, and patterning the various material layers using lithography. The material layers typically comprise thin films of conductive, semiconductive, and insulating materials that are patterned to form integrated circuits (IC's). In many integrated circuit designs, the various material layers are planarized before depositing subsequent material layers, e.g., in order to remove excess material from the surface of the wafer.

There may be a plurality of transistors, memory devices, switches, conductive lines, diodes, capacitors, logic circuits, and other electronic components formed on a single semiconductor die or chip. Semiconductor technology has experienced a trend towards miniaturization, to meet the demands of product size reduction, improved device performance, and reduced power requirements in the end applications that semiconductors are used in, for example.

In the past, integrated circuits contained only a relatively small number of devices per chip, and the devices could be easily interconnected. However, in more recent integrated circuit designs, there may be millions of devices on a single chip, resulting in the need for multilevel interconnect systems, wherein the area for interconnect lines is shared among two or more material levels.

As the number of interconnect layers in integrated circuits has increased, the planarization of dielectric and metal layers has become more critical, for example. In the past, planarization techniques such as thermal flow, sacrificial-resist etch-back, and spin-on glass were adequate to planarize interconnect systems. However, these techniques provide only a limited degree of smoothing and local planarization. For global planarization of a semiconductor wafer, chemical-mechanical polishing (CMP) is typically used.

In most CMP processes, an abrasive material is used to planarize a wafer. The abrasive may be disposed in a slurry, or the abrasive material may be fixed to a polishing pad, for example.

In a CMP process, elevated features on the wafer are selectively removed, e.g., material from higher elevation features is removed more rapidly than material at lower elevations, resulting in reduced topography. The process is referred to as "chemical-mechanical polishing" because material is removed from the wafer by mechanical polishing, assisted by chemical action.

What are needed in the art are improved CMP and polishing processes and apparatus.

SUMMARY OF THE INVENTION

These and other problems are generally solved or circumvented, and technical advantages are generally achieved, by preferred embodiments of the present invention which provide novel polishing processes and apparatus for polishing semiconductor wafers.

In accordance with a preferred embodiment of the present invention, an apparatus for polishing a semiconductor workpiece includes a polishing pad, a fluid dispenser adapted to dispense a fluid to the polishing pad, and a temperature measurement device adapted to measure the temperature of the fluid. The apparatus includes a heat exchanger adapted to increase or decrease the temperature of the fluid.

The foregoing has outlined rather broadly the features and technical advantages of embodiments of the present invention in order that the detailed description of the invention that follows may be better understood. Additional features and advantages of embodiments of the invention will be described hereinafter, which form the subject of the claims of the invention. It should be appreciated by those skilled in the art that the conception and specific embodiments disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

Corresponding numerals and symbols in the different figures generally refer to corresponding parts unless otherwise indicated. The figures are drawn to clearly illustrate the relevant aspects of the preferred embodiments and are not necessarily drawn to scale.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to preferred embodiments in a specific context, namely CMP apparatus and methods for CMP of semiconductor wafers. Embodiments of the present invention may also be applied, however, to other polishing and cleaning processes for semiconductor wafers and other objects. Embodiments of the invention may also be applied, for example, to other technologies where polishing processes are used.

Figure 1:
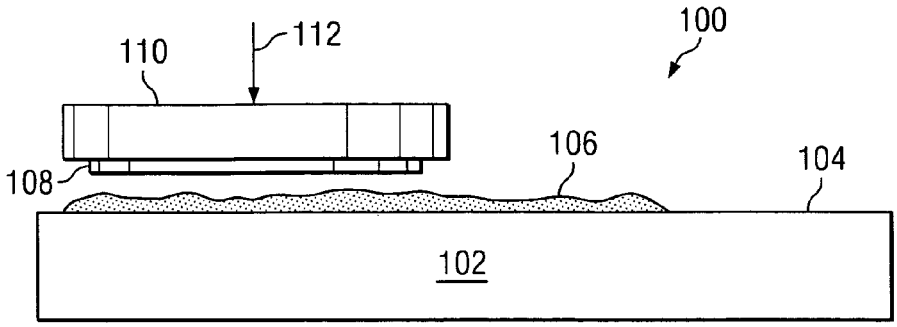
FIG. 1 (PRIOR ART)
FIG. 1 is a schematic drawing of a prior art CMP apparatus.

FIG. 1 is a schematic drawing of a prior art CMP apparatus 100. A polishing pad 104 is attached to a polishing platen 102. The back side of a semiconductor wafer 108 is mounted on a carrier 110. Using the carrier 110, the face or top surface of the semiconductor wafer 108 is pressed against the polishing pad 104 on the platen 102. The polishing pad 104 and the carrier 110 are rotated, e.g., in opposite directions or in the same direction. A fluid 106 that may comprise an abrasive-containing slurry is dripped onto the platen 102, saturating the polishing pad 104. The polishing pad 104 may include an abrasive material formed thereon. The type of abrasive material used is dependant upon the material layer to be planarized; for example, ceria or silicon oxide are often used to planarize oxide material layers, and aluminum oxide is often used to planarize copper.

Figure 2:
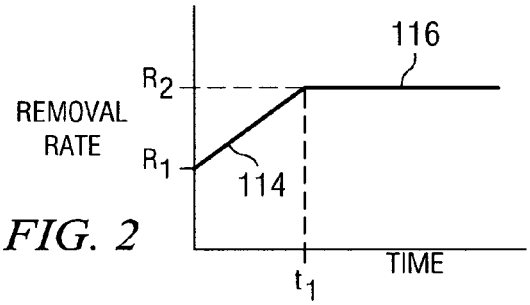
FIG. 2 is a graph illustrating the removal rate over time for a prior art CMP apparatus.

FIG. 2 is a graph illustrating the removal rate over time for a prior art CMP apparatus 100 such as the one shown in FIG. 1. During the CMP process, heat through friction is created, causing the removal rate to increase, as shown in FIG. 2 at 114. Because the temperature is lower at the start of the CMP process, the removal rate $R_1$ is lower at the beginning of the CMP process than later in the process, e.g., at 116, shown at removal rate $R_2$. The removal rate of homogenous material, e.g., a material layer formed on a semiconductor wafer 108, during a typical CMP process is generally not uniform throughout the process. In the beginning the rate is low and increases with time up to a steady state, e.g., as shown at $R_2$.

A disadvantage of prior art CMP processes and apparatus 100 such as the one shown in FIG. 1 is that the generation of excessive and non-uniform heat can cause the CMP process to become uncontrolled, resulting in an excessive amount of material being removed from a semiconductor wafer 108 and the generation of defects. Thus, CMP processes with improved control of the removal rate are needed in the art.

Another disadvantage of prior art CMP processes and apparatus 100 is that often, a relatively high downward force 112 may be applied to a semiconductor wafer 108 against the polishing pad 104 and/or slurry 106. Some more recent semiconductor wafers 108 comprise integration schemes with ultra low dielectric constant (k) material layers, which often are not structurally or mechanically very strong and are not able to withstand high downward forces 112 that are required to achieve the required high material removal rates, such as for copper bulk removal, to achieve a high throughput. Therefore, CMP processes with high removal rate at lower downward forces are needed in the art.

Furthermore, in some applications, at the end of the polishing process, it is desirable to have a less reactive material, e.g., the slurry or fluid 106 disposed on the polished wafer 108, in order to avoid chemical attack of the surface of the wafer 108. Thus, CMP processes with improved control of the reactiveness of the fluid 106 are also needed in the art.

Some prior art attempts to resolve these problems with CMP processes include maintaining the polishing platen 102 temperature constant at a certain temperature. For this approach, a complicated cooling system is built into the platen. Disadvantages of this approach include increased costs and slow temperature response, e.g., to heat or cool the platen.

Another approach to solving the above-mentioned problems of CMP processes is to use an "air knife," which involves blowing compressed air onto the polishing pad to provide cooling. However, disadvantages of this approach include risking the partial drying of the pad surface and the generation of defects on the semiconductor wafer. Plus, the air knife approach only provides cooling, and does not provide heating.

Embodiments of the present invention achieve technical advantages by providing a novel temperature control mechanism that uses the fluid disposed between a semiconductor workpiece and the polishing pad as the medium for measuring and controlling the temperature. The temperature of the slurry or fluid used in the polishing process is controlled or regulated, depending on the desired effect within a particular point in the polishing process. A preferred embodiment comprises measuring the temperature of a fluid disposed between a semiconductor workpiece and a polishing pad, and adjusting the temperature of the fluid to a predetermined temperature by heating or cooling the fluid. The temperature may be measured and adjusted at predetermined time intervals.

Figure 3:
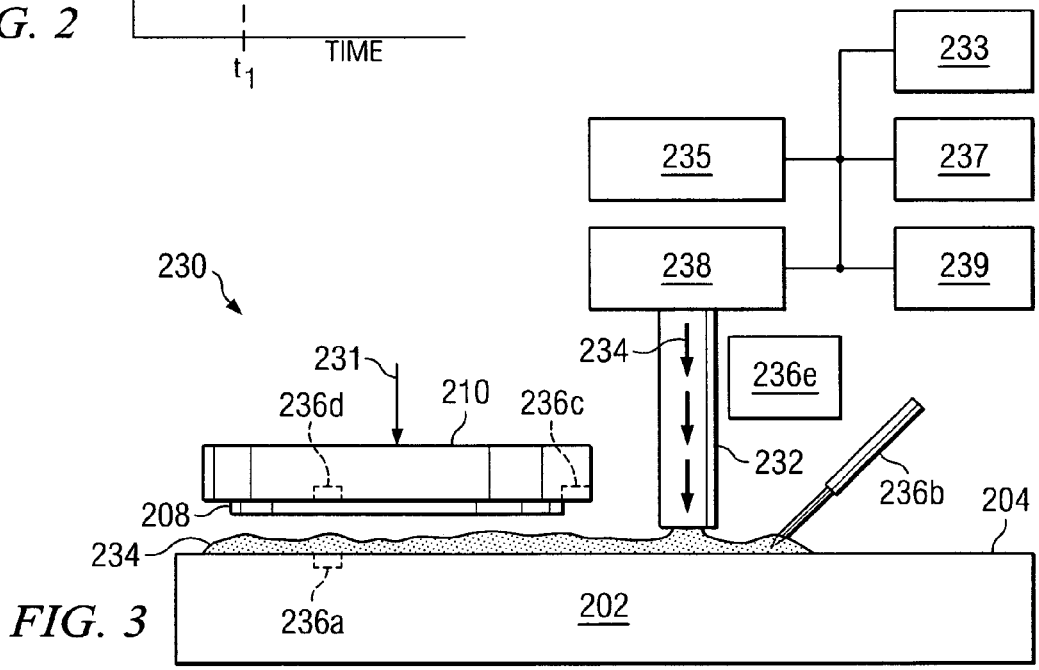
FIG. 3 is a schematic drawing of a novel polishing apparatus in accordance with a preferred embodiment of the invention, wherein temperature measurement devices are used to measure the temperature of the fluid of a polishing process.

FIG. 3 is a schematic drawing of a novel polishing apparatus 230 in accordance with a preferred embodiment of the invention, wherein one or more temperature measurement devices 236*a*, 236*b*, 236*c*, 236*d*, or 236*e* are coupled to a fluid 234 used in a CMP process. The polishing apparatus 230 preferably comprises an apparatus for polishing a semiconductor workpiece or wafer. For example, the polishing apparatus 230 may be adapted for CMP of a semiconductor workpiece or for cleaning of a semiconductor workpiece. The polishing apparatus 230 is also referred to herein as a CMP apparatus 230.

The CMP apparatus 230 includes a polishing means 202/204 that comprises a polishing platen 202 having a polishing pad 204 disposed thereon. The polishing pad 204 may comprise a fixed abrasive pad having an abrasive medium attached thereto, such as ceria oxide, silicon oxide, aluminum oxide, diamond, and/or carbon, as examples. Alternatively, the polishing pad 204 may comprise a cleaning pad that is smooth and has no or little abrasive material disposed thereon, for example.

The CMP apparatus 230 includes a support means 210 adapted to support a semiconductor workpiece 208. The support means 210 is also referred to herein as a support 210, for example. The semiconductor workpiece 208 may be adhered to the support means 210, e.g., by an adhesive or tape, as examples, although other mechanisms may be used to adhere the semiconductor workpiece 208 to the support 210. The polishing means 202/204 is moveable so that it may be moved proximate the support means 210 to polish the semiconductor workpiece 208, for example.

The semiconductor workpiece 208 may comprise a semiconductor wafer or substrate having a material layer formed thereon that will be planarized or have material removed therefrom, or a material layer that will be cleaned using the CMP apparatus 230, for example. The workpiece 208 may include a semiconductor substrate comprising silicon or other semiconductor materials covered by an insulating layer, for example. The workpiece 208 may also include other active components or circuits, not shown. The workpiece 208 may comprise silicon oxide over single-crystal silicon, for example. The workpiece 208 may include other conductive layers or other semiconductor elements, e.g., transistors, diodes, capacitors, etc., not shown. Compound semiconductors, GaAs, InP, Si/Ge, or SiC, as examples, may be used in place of silicon. The workpiece 208 may also comprise bulk Si, SiGe, Ge, SiC, or a silicon-on-insulator (SOI) substrate, as examples.

The support means 210 may be adapted to be rotated in a first direction, and the polishing means 202/204 may be adapted to be rotated in a second direction. The second direction may be different than, or the same as, the first direction, for example. The rotations in the first direction and the second direction establish the polishing action for the CMP process or a cleaning action in a cleaning process, for example.

The CMP apparatus 230 includes a fluid dispensing means adapted to dispose a fluid 234 between the semiconductor workpiece 208 disposed on the support means 210 and the polishing pad 204. The fluid dispensing means may include a fluid dispenser 232 comprising a tube or hose and being coupled to a fluid vessel 238 for containing the fluid 234 at one end of the fluid dispenser, for example. The other end of the fluid dispensing means 232 preferably has an opening proximate the polishing means 202/204, as shown.

The fluid 234 may comprise a slurry containing an abrasive material, in one embodiment. The abrasive material may comprise particles of ceria oxide, silicon oxide, or aluminum oxide, as examples, although alternatively, other abrasive particles may be used. In other embodiments, the fluid 234 does not contain an abrasive material. The fluid 234 may alternatively comprise a cleaning fluid or a lubricating fluid, as examples. For example, if the polishing pad 204 comprises a fixed abrasive, the fluid 234 may provide lubrication only, to reduce friction, or lubrication and a cleaning action. The fluid 234 may comprise a water-containing fluid, a hydrogen-peroxide containing fluid, a KOH-containing fluid, other fluids and/or combinations thereof, as examples, although alternatively, the fluid 234 may comprise other materials. The fluid 234 may comprise a water-based chemical, detergent, an acid, or a base, as examples.

The fluid 234 may be placed on the polishing pad 204 before or during the CMP process. Preferably, some fluid 234 remains residing between the polishing pad 204 and the semiconductor workpiece 208 during the polishing process, to prevent excessive abrasion or material removal from a material layer of the workpiece 208, for example.

The CMP apparatus 230 includes a means of measuring the temperature of the fluid 234. The means of measuring the temperature of the fluid is preferably disposed in or is adjacent to the fluid 234, in some embodiments, as examples. In other embodiments, the means of measuring the temperature of the fluid is disposed proximate the fluid 234. The means of measuring the temperature of the fluid 234 preferably comprises one or more temperature measurement devices 236*a*, 236*b*, 236*c*, 236*d*, or 236*e* coupled to or disposed proximate the fluid 234, as shown in FIG. 3. For example, temperature measurement device 236*a* may comprise a temperature sensor disposed on the polishing pad 204 that makes direct contact with the fluid 234 during the CMP process. As another example, temperature measurement device 236*b* may comprise a temperature probe 236*b* that is submerged in the fluid 234 proximate the area where the polishing occurs. The temperature measurement device 236*e* may also comprise a sensor that is not in direct contact with the fluid but that is adapted to measure the temperature of the fluid, such as an infrared (IR) thermal sensor disposed proximate the fluid 234. As another example, temperature measurement device 236*c* may comprise a temperature sensor disposed at an edge of the support 210 that is adapted to directly contact the fluid 234 during the polishing process. In another embodiment, temperature measurement device 236*d* may comprise a temperature sensor disposed in a central region of the support 210 proximate the semiconductor workpiece 208 being polished that is adapted to indirectly measure the temperature of the fluid 234 by measuring the temperature of the semiconductor workpiece 208. Because the semiconductor workpiece 208 is relatively thin, the temperature of the fluid 234 is transferred during through the semiconductor workpiece 208 to the temperature sensor 236*d*, for example.

The temperature measurement devices 236*a*, 236*b*, 236*c*, 236*d*, and 236*e* are adapted to measure the temperature of the fluid 234, either directly or indirectly, and may comprise thermometers or other temperature sensors, such as thermal sensors, although alternatively, the temperature measurement devices 236*a*, 236*b*, 236*c*, 236*d*, and 236*e* may comprise other devices. There may be one or more temperature measurement devices 236*a*, 236*b*, 236*c*, 236*d*, and 236*e* disposed in the CMP apparatus 230, for example.

The CMP apparatus 230 includes a means 239 of altering the temperature of the fluid 234. The means 239 of altering the temperature of the fluid 234 may comprise a heat exchanger that is adapted to increase or decrease the temperature of the fluid 234, for example. The means 239 of altering the temperature of the fluid 234 may comprise a heat exchanger, a heater, a cooler and/or combinations thereof, as examples. The means 239 of altering the temperature of the fluid 234 may also comprise other devices, for example.

The CMP apparatus 230 is preferably adapted to alter the temperature of the fluid 234 using the means 239 of altering the temperature of the fluid 234 in response to the temperature of the fluid 234 measured by the temperature measurement devices 236*a*, 236*b*, 236*c*, 236*d*, and 236*e*. For example, the CMP apparatus 230 may include a memory 235 and a processor 237. The memory 235 preferably comprises a memory device and may be adapted to store at least one predetermined temperature value. The processor 237 is preferably adapted to compare a temperature measurement of the fluid 234 made by a temperature measurement device 236*a*, 236*b*, 236*c*, 236*d*, or 236*e* to the at least one predetermined temperature value. The processor 237 is preferably adapted to indicate to the heat exchanger 239 whether to increase or decrease the temperature of the fluid 234, for example.

The memory 235 may also be adapted to store at least one predetermined time interval, and the processor 237 may be adapted to indicate to the heat exchanger 239 whether to increase or decrease the temperature of the fluid 234 at the end of the at least one predetermined time interval, for example. The apparatus 230 is preferably adapted to polish the semiconductor workpiece 208 at a first predetermined temperature value for a first predetermined time interval. Likewise, the apparatus 230 may be adapted to polish the semiconductor workpiece 208 at a second predetermined temperature value for a second predetermined time interval. Polishing of the semiconductor workpiece 208 may be performed at additional predetermined temperature values and additional predetermined time intervals, for example.

The values for the predetermined temperature values and the predetermined time intervals may be input manually by an operator of the CMP apparatus 230 before or during the polishing process, for example, or through an optional external control system 233.

Advantageously, the temperature measurement device 236*a*, 236*b*, 236*c*, 236*d*, or 236*e*, processor 237, memory 235 and optional control system 233 provide a feedback control loop for the temperature of the fluid 234. For example, in some embodiments, the temperature measurement device 236*a*, 236*b*, 236*c*, 236*d*, or 236*e* is preferably adapted to measure the temperature of the fluid 234 periodically, e.g., every few seconds or minutes, during a predetermined time interval, wherein if the measured temperature is greater than or less than the predetermined temperature value, the heat exchanger 239 cools or heats the fluid to reach the predetermined temperature value. Thus, the temperature of the fluid 234 is measured, monitored, regulated, and controlled real-time by embodiments of the present invention.

Figure 4:
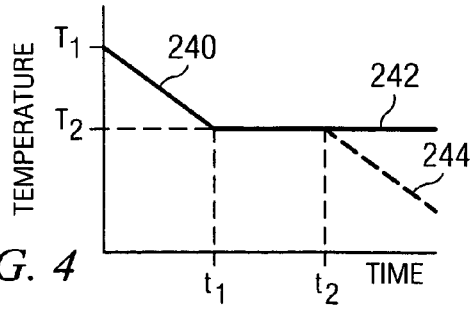
FIG. 4 is a graph of a temperature profile in accordance with an embodiment of the present invention showing temperature vs. time, wherein the temperature of the fluid at the start of the CMP process is initially higher to facilitate the CMP process.
Figure 5:
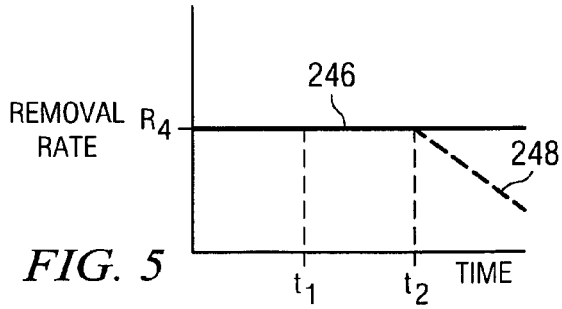
FIG. 5 is a graph of removal rate vs. time for the temperature profile in accordance with the embodiment of the present invention shown in FIG. 4.

FIG. 4 is a graph 240/242 of a temperature profile in accordance with an embodiment of the present invention, showing temperature vs. time during a CMP process of a semiconductor workpiece 208 using the CMP apparatus 230 of FIG. 3. The temperature $T_1$ of the fluid 234 at the start of the CMP process is preferably initially higher than later in the process in one embodiment, as shown at temperature $T_2$ starting at time $t_1$, in order to facilitate the removal of material during the CMP process. As the CMP process continues, e.g., at time $t_1$, the temperature of the fluid 234 is reduced using the heat exchanger 239 to temperature $T_2$. FIG. 5 is a graph 246 of removal rate vs. time for the temperature profile in accordance with the embodiment of the present invention shown in FIG. 4. Advantageously, the removal rate 246 may be maintained to be relatively constant, as shown at 246, due to the temperature adjustment. By increasing the temperature $T_1$ at the beginning of the CMP process, an increased rate of removal $R_4$ can be achieved at the start of the CMP process, for example.

Optionally, in another embodiment, as shown in phantom at 244 in FIG. 4 and at 248 in FIG. 5, the temperature of the fluid 234 may be reduced towards the end of the CMP process, e.g., beginning at time $t_2$. This embodiment is advantageous in that the reactiveness of the fluid 234 may be reduced by decreasing the temperature, slowing the removal rate to a rate less than $R_4$, as shown at 248.

Other temperature profiles and removal rates may also be used, depending on the application and the desired CMP process, for example, not shown. The temperature of the fluid 234 may be modified and adjusted to higher or lower temperatures during the CMP process a number of times, for example, not shown. If the polishing process is used to clean a workpiece 208 rather than to remove material, the temperature of the fluid 234 may also be modified to increase or decrease the cleaning rate over time, for example.

Figure 6:
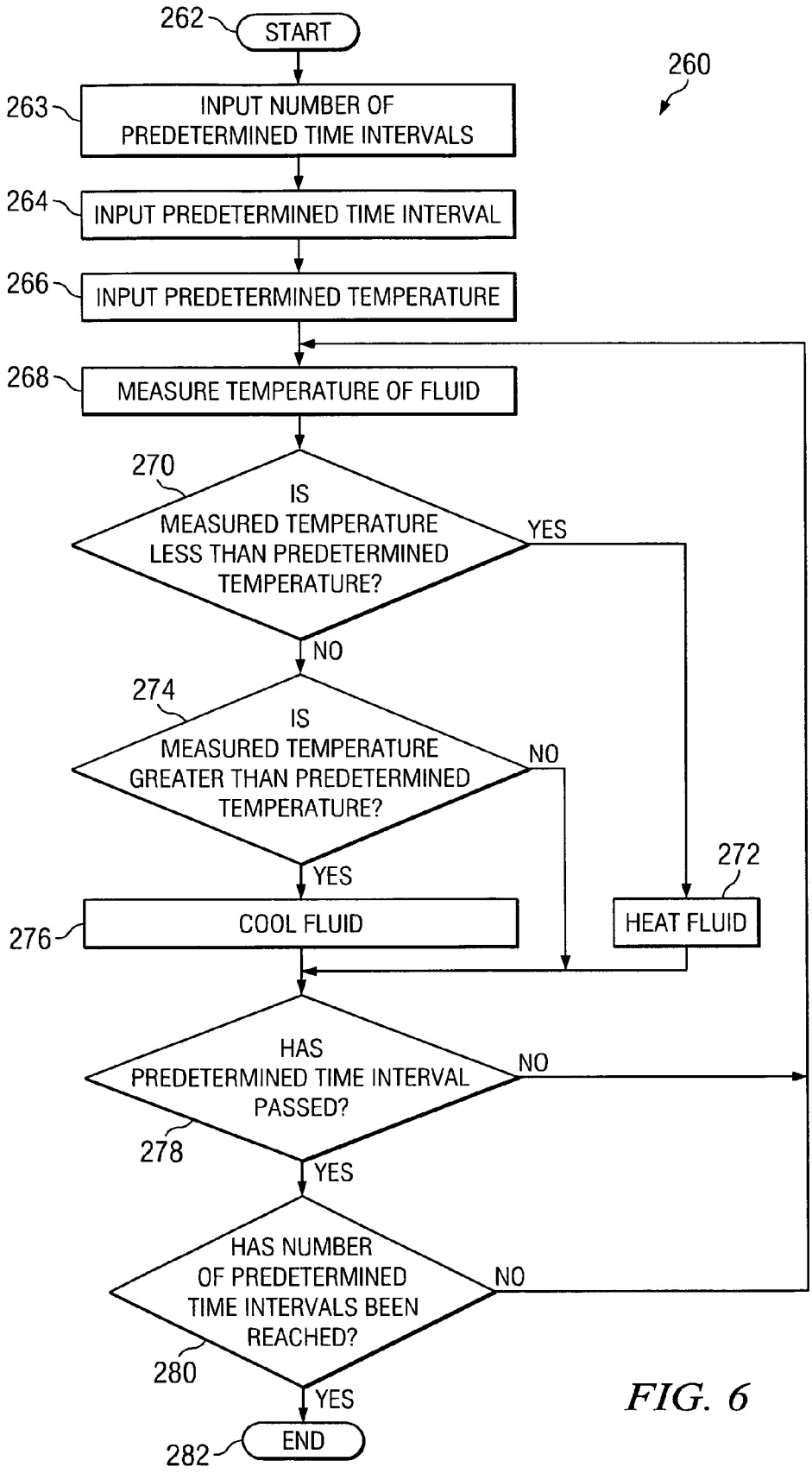
FIG. 6 is a flow chart illustrating processing steps for a polishing process in accordance with an embodiment of the present invention.

FIG. 6 is a flow chart 260 illustrating processing steps for a CMP process in accordance with an embodiment of the present invention. At step 262, the CMP or polishing process, e.g., with the CMP apparatus 230 shown in FIG. 3 is started. A number of predetermined time intervals may be input by an operator of the CMP apparatus 230 (step 263), and at least one predetermined time interval is input by the operator (step 264). At least one predetermined temperature is input by the operator (step 266). These values may also be input by a control system 233, for example. The temperature of the fluid 234 is measured (step 268), e.g., using a temperature measurement device 236*a*, 236*b*, 236*c*, 236*d*, and/or 236*e*. If the measured temperature is less than the predetermined temperature (step 270), then the fluid 234 is heated (step 272), e.g., using the heat exchanger 239. If the measured temperature is greater than the predetermined temperature (step 274), then the fluid 234 is cooled (step 276), e.g., using the heat exchanger 239. If the predetermined time interval has not passed (step 278), then the temperature of the fluid is measured periodically (step 268) until the predetermined time interval has passed. If the predetermined time interval has passed (step 278), then if the number of predetermined time intervals has been reached (step 280), then the CMP process is ended (step 282). If the number of predetermined time intervals has not been reached (step 280), then the CMP process returns to step 268, or optionally may return to an earlier step such as step 264, for example.

The flow chart 260 shown in FIG. 6 is merely an example of a method of using a novel CMP apparatus 230 of the present invention. Alternatively, other methods and processes may be used. In a preferred embodiment, however, a method of polishing a semiconductor workpiece 208 comprises periodically repeating measuring the temperature of the fluid 234, comparing the at least one predetermined temperature value to the measured temperature of the fluid 234, and adjusting the temperature of the fluid 234 to be substantially the same as the at least one predetermined temperature value while polishing the semiconductor workpiece 208.

The novel CMP apparatus 230 described herein is shown in the drawings with the polishing platen 202 being larger than the semiconductor workpiece 208; however, alternatively, the polishing platen 202 may be smaller or larger than the semiconductor workpiece 208 being planarized, for example. The polishing platen 202 may be larger than the semiconductor workpiece 208 by about 2 inches on each side, or alternatively, the polishing platen 202 may be larger than the semiconductor workpiece 208 by several times the diameter of the wafer. One or more CMP devices 230 may be used at a time to planarize a surface of a semiconductor device or give it a predetermined shape, for example. The polishing platen 202 described herein may also comprise a large sheet, e.g., they may be coupled to or may be part of a moving winding belt, and a portion of the winding belt may be used at a time for the CMP process. More than one semiconductor workpiece 208 may be attached to a support 210, and multiple semiconductor workpieces 208 may be polished simultaneously in accordance with embodiments of the present invention.

Advantages of embodiments of the invention include providing improved control of CMP processes by controlling the temperature of the fluid 234. The CMP apparatus 230 comprises a slurry temperature regulation system, wherein a heat exchanger is used to adjust the slurry or fluid 234 temperature. Removal rates are well-controlled and may be varied by varying the temperature at different stages of the CMP process. The reactiveness of the fluid 234 is well-controllable by controlling the temperature of the fluid 234. Higher rates of removal at lower downward forces 231 (see FIG. 3) may be achieved by embodiments of the present invention, e.g., by increasing the temperature of the fluid 234.

Control of the wafer (e.g., workpiece 208) temperature can be achieved through change of the incoming fluid 234 temperature, resulting in improved process stability. The temperature of the fluid 234 may be reduced towards the end of the polishing process, while leaving the same amount of fluid 234 on the workpiece 208, reducing the risk of corrosion defects, because the fluid 234 is less reactive at the lower temperature. Simultaneously, in one embodiment, a lower downward pressure or force 231 may be applied, leaving a thicker fluid 234 film on the workpiece 208 and resulting in an improved heat exchange, also resulting in defect reduction.

Furthermore, in other embodiments, a chemical reaction, e.g., of the fluid 234 with the semiconductor workpiece 208 surface, may be accelerated in the beginning of the CMP process by warming the fluid 234, resulting in a more reactive slurry/chemical (e.g., fluid 234) having an increased removal rate. This results in a higher throughput and is particularly advantageous when used to remove bulk materials such as copper, for example.

By using an elevated temperature rate of the fluid 234, e.g., above room temperature, the overall removal rate for a material can be increased, e.g., for a given downward force 231, resulting in a higher throughput. Embodiments of the present invention also allow CMP processes to be used wherein a reduced downward force 231 may be applied to a workpiece 208, and thus the methods and apparatus 230 described herein are particularly beneficial when used to planarize or clean semiconductor workpieces 208 having low k material layers formed thereon.

The novel method of controlling the temperature of the fluid 234 described herein is not limited to a polishing process within a CMP tool. The novel processes described herein may also be implemented in cleaning processes and tools, such as in cleaning processes and apparatus used after a CMP process, as an example.

Although embodiments of the present invention and their advantages have been described in detail, it should be understood that various changes, substitutions and alterations can be made herein without departing from the spirit and scope of the invention as defined by the appended claims. For example, it will be readily understood by those skilled in the art that many of the features, functions, processes, and materials described herein may be varied while remaining within the scope of the present invention. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An apparatus for polishing a semiconductor workpiece, the apparatus comprising:

a polishing pad;

a fluid dispenser adapted to dispense a fluid to the polishing pad;

a temperature measurement device adapted to measure the temperature of the fluid; and a heat exchanger adapted to increase or decrease the temperature of the fluid, wherein the apparatus is adapted to polish the semiconductor workpiece at a first predetermined temperature for a first predetermined time interval.

2. The apparatus according to claim 1, further comprising a processor and memory coupled to the temperature measurement device, wherein the memory is adapted to store the first predetermined temperature value, and wherein the processor is adapted to compare a temperature measurement made by the temperature measurement device to the first predetermined temperature value.

3. The apparatus according to claim 2, wherein the memory is adapted to store the first predetermined time interval, wherein the processor is adapted to indicate to the heat exchanger whether to increase or decrease the temperature of the fluid at the end of the first time interval.

4. The apparatus according to claim 2, wherein the processor is further adapted to indicate to the heat exchanger whether to increase or decrease the temperature of the fluid.

5. The apparatus according to claim 1, wherein the fluid dispenser is adapted to dispense an abrasive-containing fluid, a cleaning fluid, or a lubricating fluid.

6. An apparatus for polishing a semiconductor workpiece, the apparatus comprising:

a support for a semiconductor workpiece;

a polishing pad proximate the support;

a vessel for containing a fluid;

a fluid dispenser adapted to dispense the fluid to the polishing pad;

a temperature measurement device adapted to measure the temperature of the fluid;

a memory device adapted to store at least one predetermined temperature value, wherein the memory device is also adapted to store at least one predetermined time interval, wherein the apparatus is adapted to polish the semiconductor workpiece at a first predetermined temperature value for a first predetermined time interval;

a processor adapted to compare a fluid temperature measurement of the temperature measurement device to the at least one predetermined temperature value; and a heat exchanger adapted to increase or decrease the temperature of the fluid based on the comparison of the fluid temperature measurement to the at least one predetermined temperate value.

7. The apparatus according to claim 6, wherein the temperature measurement device comprises a thermometer disposed in the fluid, disposed on the support for the semiconductor workpiece, disposed on the polishing pad, or an infrared (IR) thermal sensor proximate the fluid.

8. The apparatus according to claim 6, wherein the support is adapted to rotate in a first direction, and wherein the polishing pad is adapted to rotate in a second direction, wherein the first direction comprises the same or opposite direction as the second direction.

9. The apparatus according to claim 6, wherein the temperature measurement device is adapted to measure the temperature of the fluid periodically during the first predetermined time interval, wherein if the measured temperature is greater than or less than the first predetermined temperature value, the heat exchanger cools or heats the fluid to reach the first predetermined temperature value.

10. The apparatus according to claim 6, wherein the memory device is also adapted to store a second predetermined time interval and a second predetermined temperature value, wherein after the first predetermined time interval, the heat exchanger adjusts the temperature of the fluid to the second predetermined temperature value, and the apparatus is adapted to polish the semiconductor workpiece at the second predetermined temperature value for a second predetermined time interval.

11. An apparatus for polishing a semiconductor workpiece, the apparatus comprising:

means for supporting a semiconductor workpiece;

means for polishing the semiconductor workpiece;

fluid dispensing means for dispensing a fluid between a semiconductor workpiece and the means for polishing;

means for storing a predetermined time interval and a predetermined temperature value;

means for measuring the temperature of the fluid; and means for altering the temperature of the fluid;

wherein the apparatus is adapted to polish the semiconductor workpiece at the predetermined temperature value for the predetermined time interval.

12. The apparatus according to claim 11, wherein the means for polishing comprises a fixed abrasive pad.

13. The apparatus according to claim 11, wherein the means of for measuring the temperature of the fluid comprises a temperature sensor disposed in the fluid.

14. The apparatus according to claim 11, wherein the means for altering the temperature of the fluid comprises a heater, a cooler, or combinations thereof.

15. A method of polishing a semiconductor workpiece, the method comprising:

providing a support for the semiconductor workpiece;

providing a semiconductor workpiece;

placing the semiconductor workpiece on the support;

providing a polishing pad proximate the semiconductor workpiece;

disposing a fluid between the semiconductor workpiece and the polishing pad;

receiving a predetermined temperature value and a predetermined time interval;

measuring the temperature of the fluid;

altering the temperature of the fluid; and polishing the semiconductor workpiece, wherein the semiconductor workpiece is polished at the first predetermined temperature value for the first predetermined time interval.

16. The method according to claim 15, further comprising measuring the temperature of the fluid and altering the temperature of the fluid while polishing the semiconductor workpiece.

17. The method according to claim 15, wherein measuring the temperature of the fluid comprises using a probe inserted into the fluid, using a thermometer disposed on the support or the polishing pad, or using an infrared (IR) thermal sensor disposed proximate the fluid, to measure the temperature of the fluid.

18. The method according to claim 15, wherein providing the means of altering the temperature of the fluid comprises providing a heat exchanger adapted to increase or decrease the temperature of the fluid.

19. The method according to claim 15, wherein polishing the semiconductor workpiece comprises cleaning the semiconductor workpiece, removing material from a surface of the semiconductor workpiece, or planarizing a material layer disposed on the semiconductor workpiece.

20. A method of polishing a semiconductor workpiece, the method comprising:

providing a support for the semiconductor workpiece;

providing a semiconductor workpiece;

placing the semiconductor workpiece on the support;

providing a polishing pad proximate the semiconductor workpiece;

disposing a fluid between the semiconductor workpiece and the polishing pad;

inputting at least one temperature value;

measuring the temperature of the fluid;

comparing the at least one temperature value to the measured temperature of the fluid;

adjusting the temperature of the fluid to be substantially the same as the at least one temperature value;

polishing the semiconductor workpiece; and periodically repeating measuring the temperature of the fluid, comparing the at least one temperature value to the measured temperature of the fluid, and adjusting the temperature of the fluid to be substantially the same as the at least one temperature value while polishing the semiconductor workpiece.

21. The method according to claim 20, further comprising inputting at least one time interval, wherein polishing the semiconductor workpiece comprises polishing the workpiece for the at least one time interval at the at least one temperature value.

22. The method according to claim 20, wherein adjusting the temperature of the fluid comprises heating or cooling the fluid.

23. The method according to claim 20, wherein disposing the fluid comprises disposing a water-containing fluid, a hydrogen-peroxide containing fluid, a KOH-containing fluid, an abrasive-containing fluid, a cleaning fluid, or a lubricating fluid.

24. The method according to claim 20, wherein polishing the semiconductor workpiece comprises removing at least a portion of a material layer from a surface of the semiconductor workpiece, or cleaning the workpiece.

* * * * *

UNITED STATES PATENT AND TRADEMARK OFFICE

CERTIFICATE OF CORRECTION

PATENT NO. : 7,201,634 B1
APPLICATION NO. : 11/273134
DATED : April 10, 2007
INVENTOR(S) : Naujok et al.

It is certified that error appears in the above-identified patent and that said Letters Patent is hereby corrected as shown below:

Column 11, line 4: delete “means of” insert --means--

Signed and Sealed this

Seventh Day of August, 2007

JON W. DUDAS
*Director of the United States Patent and Trademark Office*